US009032844B2

(12) United States Patent
Bullard

(10) Patent No.: US 9,032,844 B2
(45) Date of Patent: May 19, 2015

(54) METHOD AND SYSTEM FOR HOLDING NAILS

(71) Applicant: Ivy Bullard, Moriarity, NM (US)

(72) Inventor: Ivy Bullard, Moriarity, NM (US)

(73) Assignee: Dolphin Grips LLC, Moriarty, NM (US)

( * ) Notice: Subject to any disclaimer, the term of this patent is extended or adjusted under 35 U.S.C. 154(b) by 0 days.

(21) Appl. No.: 14/173,235

(22) Filed: Feb. 5, 2014

(65) Prior Publication Data

US 2014/0260814 A1 Sep. 18, 2014

Related U.S. Application Data

(63) Continuation-in-part of application No. 14/076,563, filed on Nov. 11, 2013.

(60) Provisional application No. 61/789,512, filed on Mar. 15, 2013.

(51) Int. Cl.

| | |
|---|---|
| ***B25C 3/00*** | (2006.01) |
| ***A41D 19/015*** | (2006.01) |
| *A41D 13/08* | (2006.01) |

(52) U.S. Cl.

CPC ..... *B25C 3/008* (2013.01); *A41D 19/01594* (2013.01); *B25C 3/00* (2013.01); *A41D 13/087* (2013.01)

(58) Field of Classification Search

CPC ..... A41D 19/01594; A41D 13/087; B25C 3/008; B25C 3/00

USPC ..... 81/44, 436, 451, 454, 455, 488; 2/160, 2/161.6, 159, 161.7, 163, 1; 623/57, 64, 623/65, 66.1; 131/329, 257, 258, 330, 187; 206/338, 340, 349; 294/99.2, 99.1

See application file for complete search history.

(56) References Cited

U.S. PATENT DOCUMENTS

| | | | | |
|---|---|---|---|---|
| 337,905 | A | 3/1886 | Wheelock | |
| 2,348,962 | A | 5/1944 | Davis | |
| 2,420,869 | A | 5/1947 | Davis | |
| 2,438,989 | A * | 4/1948 | Billman | 269/221 |
| 2,467,613 | A | 4/1949 | Davis | |
| 2,530,688 | A | 11/1950 | Ducot | |
| 2,563,677 | A | 8/1951 | Frazier | |
| 2,788,817 | A | 4/1957 | Leniz | |
| 2,878,476 | A | 3/1959 | Auchard | |
| 3,293,958 | A | 12/1966 | Smith | |
| 3,729,035 | A | 4/1973 | Manzanarez | |
| 3,913,646 | A | 10/1975 | Grayson | |
| 4,079,765 | A | 3/1978 | Hatayan | |

(Continued)

FOREIGN PATENT DOCUMENTS

| | | | |
|---|---|---|---|
| DE | 43 02 559 A1 | 8/1994 | |
| DE | 4302559 A1 * | 8/1994 | B25C 3/00 |

*Primary Examiner* — Hadi Shakeri
*Assistant Examiner* — Melanie Alexander
(74) *Attorney, Agent, or Firm* — Kevin Soules; Kermit D. Lopez; Luis M. Ortiz

(57) ABSTRACT

A method, system, and apparatus for holding a connecting instrument comprises a first member including a first finger cup and a first needle nose tip formed on the forward end of the finger cup and a second member comprising a second finger cup and a second needle nose tip formed on the forward end of the second finger cup wherein the first needle nose tip and the second needle nose tip are configured to grip a connecting device as it is being driven into a target.

14 Claims, 7 Drawing Sheets

(56) References Cited

U.S. PATENT DOCUMENTS

| | | | | | |
|---|---|---|---|---|---|
| 4,796,302 | A | | 1/1989 | Davis et al. | |
| 4,926,718 | A | * | 5/1990 | Cook | 81/44 |
| 5,234,142 | A | * | 8/1993 | Loewen et al. | 223/101 |
| 5,375,488 | A | | 12/1994 | Baitner | |
| 5,706,520 | A | * | 1/1998 | Thornton et al. | 2/21 |
| 5,893,303 | A | * | 4/1999 | Harris | 81/44 |
| 6,009,557 | A | * | 1/2000 | Witta | 2/159 |
| 6,098,498 | A | * | 8/2000 | Ming et al. | 81/44 |
| 6,145,128 | A | * | 11/2000 | Suzuki | 2/21 |
| 6,925,653 | B1 | * | 8/2005 | King | 2/21 |
| 2004/0035255 | A1 | | 2/2004 | Rion | |
| 2005/0086722 | A1 | * | 4/2005 | Bjorntwedt | 2/161.6 |

* cited by examiner

METHOD AND SYSTEM FOR HOLDING NAILS

CROSS-REFERENCE TO PROVISIONAL APPLICATION

This patent application is a Continuation-in-Part of U.S. Non-Provisional application Ser. No. 14/076,563, filed Nov. 11, 2013, entitled "METHOD AND SYSTEM FOR HOLDING NAILS," which claims the benefit under 35 U.S.C. §119 (e) of U.S. Provisional Application 61/789,512 filed Mar. 15, 2013 entitled "NAIL HOLDING SYSTEM". This patent application claims the benefit of the preceding applications. The disclosures of the above-referenced applications are hereby incorporated herein by reference in their entirety.

FIELD OF THE INVENTION

Embodiments are generally related to the field of safety devices. More particularly, embodiments relate to methods and systems for holding a nail operated by a user's fingers.

BACKGROUND

In general, installing a nail requires a workman to hold the nail between the workman's fingers, while a hammer is used to drive the nail. This operation is well known but inherently suffers from the dangerous relationship between the workman's fingers and the driving instrument. As the workman operates the hammer, the workman's fingers are left exposed to the driving surface of the hammer. It is painfully common for the hammer to unintentionally impact a workman's fingers.

Some prior art systems have attempted to rectify these problems by providing various forms of protection for a workman's fingers. However, these inventions are often cumbersome and difficult to use, or do not provide an adequate grip on the nail to ensure it can be driven truly.

In addition, prior art systems are often not well equipped to engage varying sized nails, varying sized screws, and other connecting devices adequately. Therefore, a need exists for methods and systems to protect a user's fingers while driving a nail.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for protecting a user's fingers.

It is another aspect of the disclosed embodiments to provide for an enhanced method and system for protective finger covers capable of holding a nail, screw, or other device as it is driven.

The aforementioned aspects and other objectives and advantages can now be achieved as described herein. An apparatus for holding a connecting instrument comprises a first member comprising a first finger cup and a first needle nose tip formed on a forward end of the first finger cup and a second member comprising a second finger cup and a second needle nose tip formed on a forward end of the second finger cup. In addition, a joint can connect the first member and the second member wherein the first needle nose tip and the second needle nose tip are configured to grip a connecting device.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof. Various modifications to the preferred embodiments, disclosed herein, will be readily apparent to those of ordinary skill in the art and the disclosure set forth herein may be applicable to other embodiments and applications without departing from the spirit and scope of the present specification and the claims hereto appended. Thus, the present specification is not intended to be limited to the embodiments described, but is to be accorded the broadest scope consistent with the disclosure set forth herein.

Figure 1:
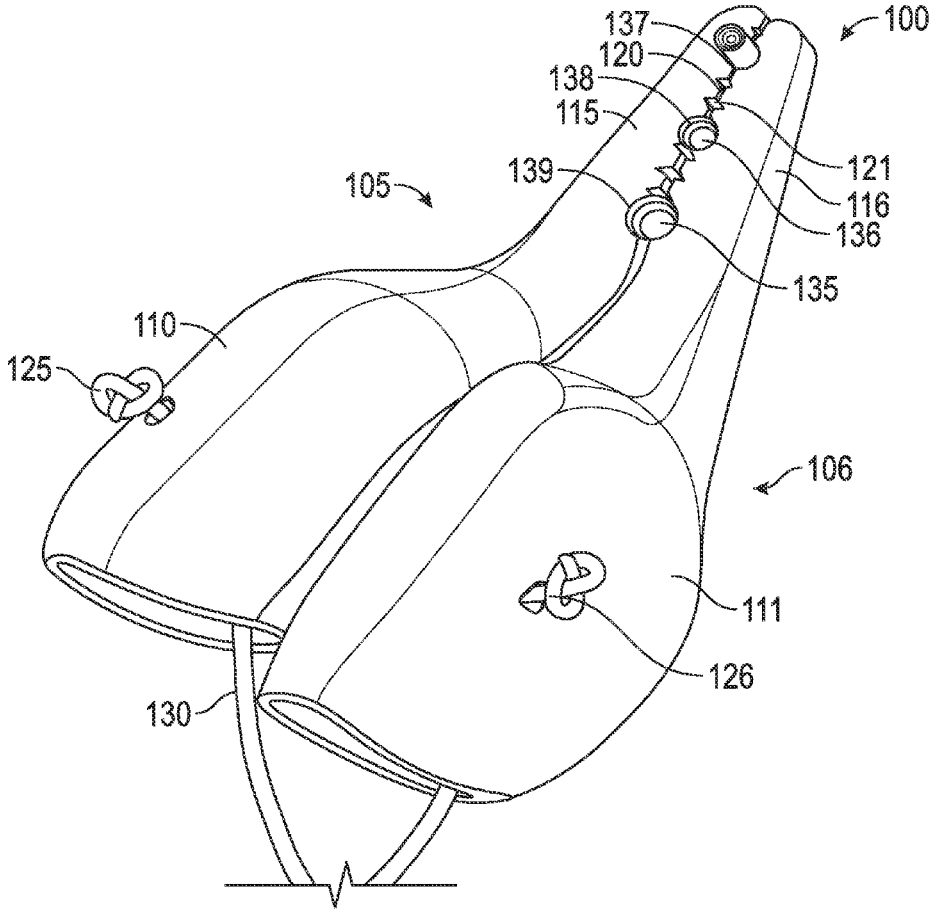
FIG. 1 depicts a top view of a system and apparatus for gripping a nail.

FIG. 1 illustrates a protective system or apparatus 100 for gripping a nail as it is driven into a target. Apparatus 100 includes a first member 105 and a second member 106. The first member 105 has a thimble like finger cup 110 with an elongated needle nose tip 115. Likewise, the second member 106 includes a thimble like finger cup 111 and an elongated needle nose tip 116. Both needle nose tips 115 and 116 include teeth 120 and 121 respectively, that are formed to help hold a connecting device such as a nail, screw, bolt, rivet, tack, thumbtack, or the like as it is driven into a target.

Each of members 105 and 106 include connections 125 and 126 respectively that are connected to a lanyard 130, or other such retaining device. In an alternative embodiment, the lanyard may be connected to a wrist strap (not shown) to secure the finger cups 110 and 111 to the user's hand.

Needle nose 115 and 116 can be configured so that as the two needle nose tips 115 and 116 are brought together, the closed jaws create tubular recesses such as tubular recesses 135 and 136. Alternatively, needle nose 115 and 116 can be configured with two half-circular forms so that as the two needle nose tips 115 and 116 are brought together the closed jaws create a hollow tubular extension 137. The recesses 135 and 136, or tubular extension 137 are formed to allow a convenient grip of a connecting member such as a nail, screw, bolt, tack, rivet or the like. The size and shape of tubular recesses 135 and 136, or tubular extension 137 can be varied so that they fit any number of connecting devices. For example, in FIG. 1, recess 135 has a larger diameter than 136, thus allowing a larger diameter connecting device to be held in the recess. Likewise, recess 136 is larger than tubular extension 137. Any number of recesses and tubular extensions may be advantageously included in apparatus 100 and may include standard sizes for nails, screws, bolts, rivets, and the like.

In addition, any or all of recesses 135 and 136 and tubular extension 137 can include a layer of metal, Teflon, Nylon, fiberglass, hard plastic, rubber, or other such material 138. Generally speaking, driving a connecting member into a target will cause friction with the side walls of the needle nose tips 115 and 116 or the side walls of a recess such as 136. Over a long period of time, this friction can wear away the material damaging the grip. This is especially true when the connecting member is a screw or other threaded device. As the screw is driven into the target, the threads of the screw can chew away at the material in the needle nose tips 115 and 116. Therefore, material 138 can be coated along the inner rims of recesses 135 and 136, or along the entire inner surface of tubular extension 137 to prevent damage to the structure of the needle nose tips 115 and 116. Additionally, in another embodiment material 138 can also be coated on the inner facing walls and teeth 120 and 121 of needle nose tips 115 and 116.

Recesses 135 and 136 and tubular extension 137 can also be configured to include threading 139 on their inner surfaces (shown in recesses 135). This threading can allow a screw to naturally spin through the recess without biting into material 138 or needle nose tip 115 or 116. It should be appreciated that the threading 139 can be configured to accept any desired threading size and spacing, and can be used in any sized recess or tubular extension according to design considerations. In addition, threading 139 and material 138 can both be applied to the recesses 135, 136, or tubular extension 137 in order to provide better protection of the needle nose tips 115 and 116 material.

Figure 2:
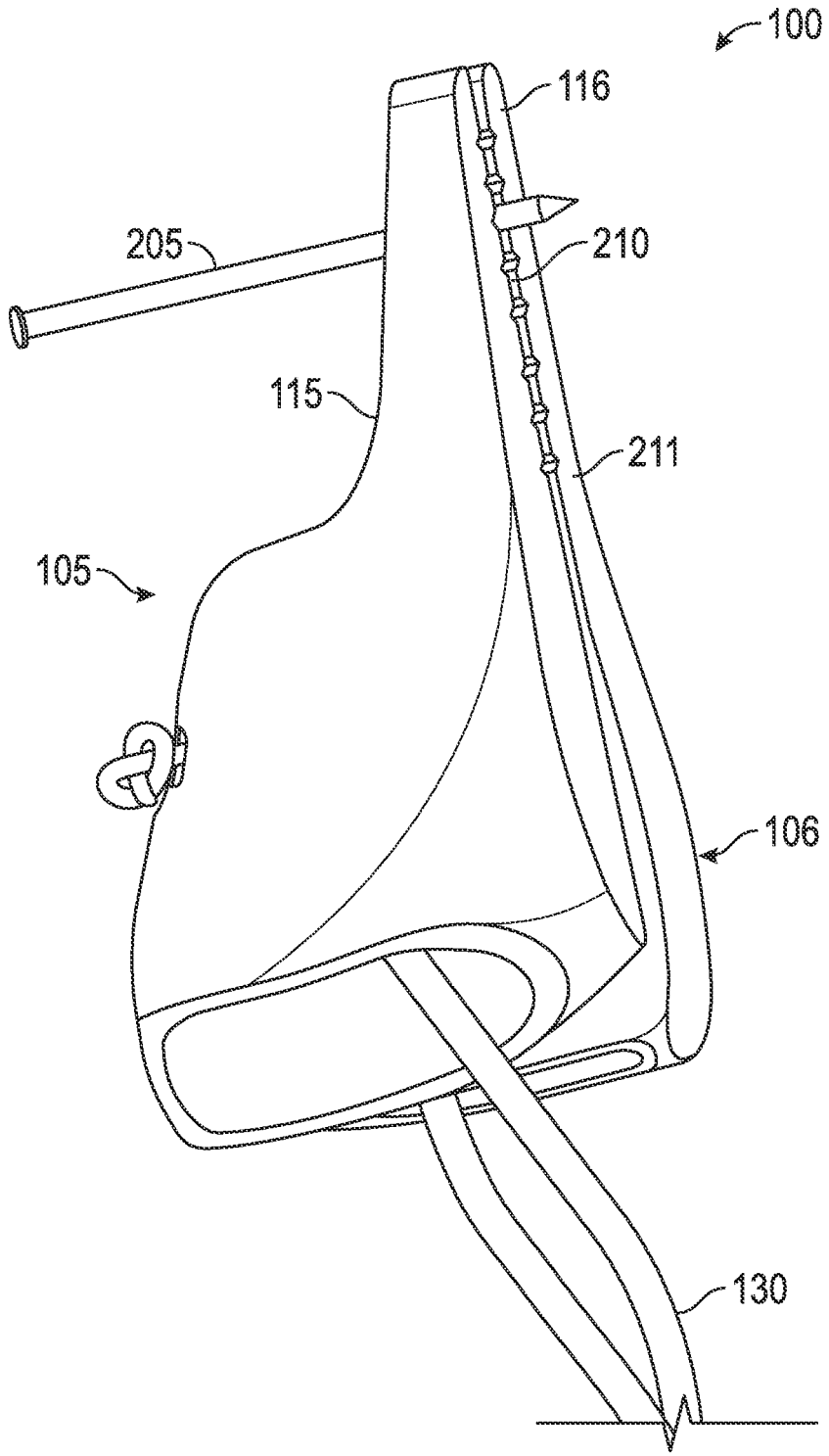
FIG. 2 depicts a side view of a system and apparatus for gripping a nail.

FIG. 2 illustrates a vertical side view of the system or apparatus 100. In this view, it is clear that the exterior bottom surfaces 210 and 211 of members 105 and 106 respectively, are flat. This allows the system 100 to be placed flush against a target making the system easy to maneuver to the proper position on the target.

In addition, in FIG. 2 a nail 205 is shown grasped between needle nose tips 115 and 116. Finger cup 110 illustrated in FIG. 1 is configured to ergonomically accept a user's left index finger and finger cup 111 is configured to ergonomically accept a user's left thumb. The internal shape of each respective finger cup is intended to fit the shape of the user's fingers and may be configured to cover the finger up to or beyond the finger's first joint. In this embodiment, it is assumed that the user is right-handed and thus would prefer to operate a driving device, such as a hammer, with their right hand. However, it should be appreciated that in an alternate embodiment finger cup 110 could be configured to ergonomically accept a user's right index finger and finger cup 111 could be configured to ergonomically accept a user's right thumb. In that embodiment, it is assumed the user is left-handed. In yet another embodiment, a user can select the configuration of finger cups 110 and 111 for a left hand or a right hand as they prefer.

Figure 3:
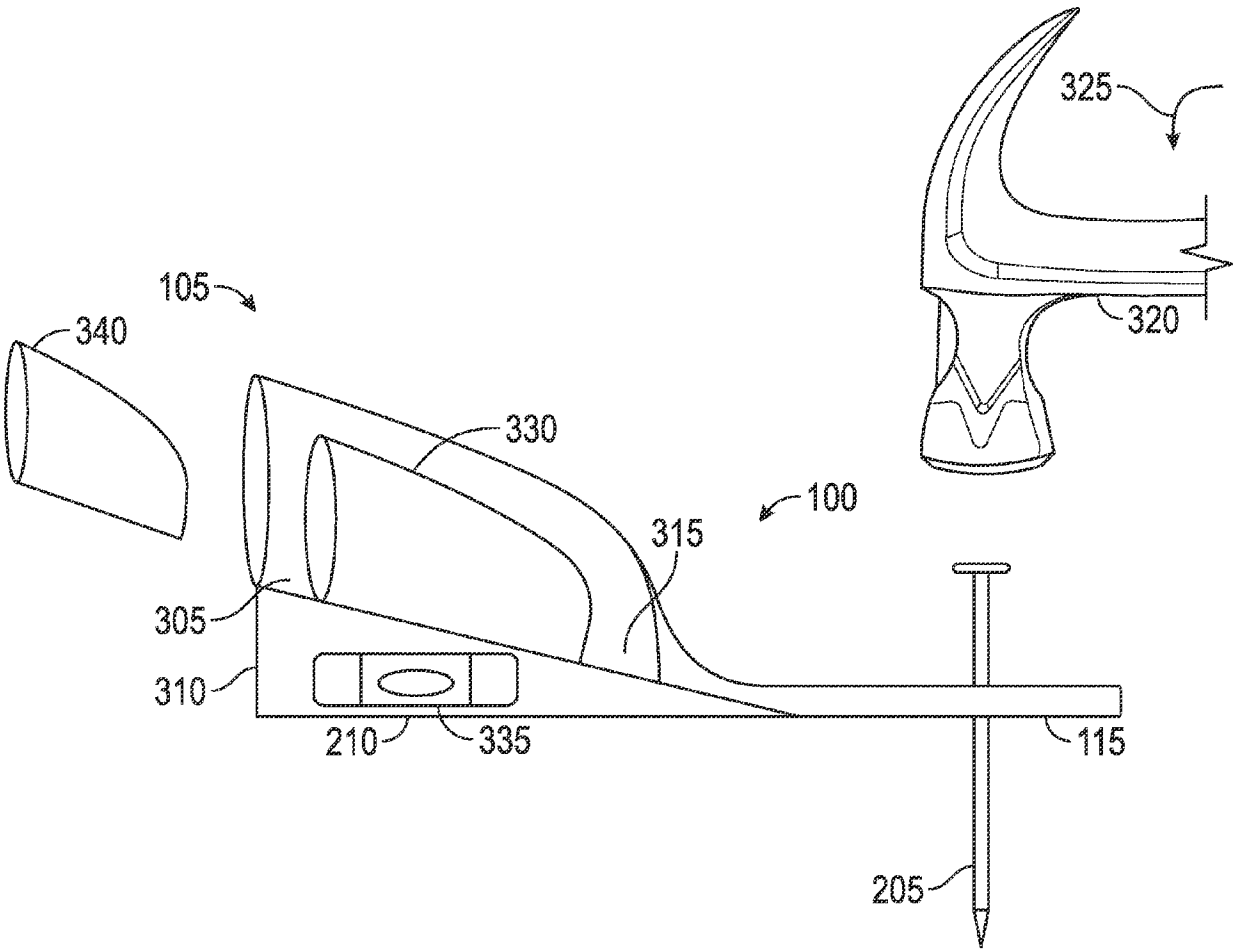
FIG. 3 depicts a side view of the internal structure comprising a system and apparatus for gripping a nail.

FIG. 3 illustrates a horizontal side view of system 100. This perspective illustrates that the interior bottom side 310 of finger cup 110 (or equivalently finger cup 111) is wedge shaped. Therefore, the interior forward side 315 is below the interior back side 305 when the member 105 (or 106) is placed flush against the target. This allows a user to slide their fingers into the respective finger cups 110 and 111 at a downward angle.

This downward angle is critically important to the ease of use of the system. In rests, when the finger cups were provided without this wedge it was exceedingly difficult to maneuver the device along a flat surface because a human hand does not naturally lie flat against the surface. However, with the wedged shape of the bottom side 310, a user can easily insert their fingers in the finger cups 110 and 111 and slide the system 100 around the surface of a flat target. Furthermore, it is essentially impossible to hold the device on the edge of a flat surface without the wedge shaped interior bottom side 310 that allows the user to insert their fingers at a downward angle.

In one embodiment, member 105, and specifically finger cup 110 (or equivalently member 106 and finger cup 111), can include an integrated reinforcement structure 330. Reinforcement structure 330 is preferably integrated inside the material forming the finger cup 110. In a preferred embodiment, reinforcement structure 330 is formed of metal, however, any sufficiently hard material such as plastic, hard rubber, or the like could also be used. In principle, the reinforcement structure 330 is formed to prevent or retard the deformation of finger cup 110 or 111 when it is inadvertently struck by a hammer, drill or other driving device, thereby protecting the workman's finger inside.

FIG. 3 further includes an illustration of a hammer 320 being operated according to arrow 325 to drive nail 205. In this illustration, nail 205 is being gripped between needle nose tips 115 and 116. It should be appreciated that a user could preferably impart the motion on hammer 320 indicated by arrow 325, or in another direction conducive to driving the nail as the situation may dictate.

FIG. 3 also illustrates a level 335 that can be embedded in the interior bottom side wedge 310. The level can be integrated in the interior bottom side 310 so that when the member 105 (or equivalently member 106) is viewed from the side, or in another embodiment not shown, from the back, the level is visible. Level 335 is configured to indicate whether or not the target that member 105 is placed flush against is flat. In one alternative embodiment, a flat, telescoping slide (not shown) can be configured on the back end of interior bottom side 310 wedge. The telescoping slide can be extended out the back of member 105. This telescoping slide can lie flush against a longer surface, in the same plane as member 105, allowing an operator to measure the flatness of a much larger surface, using level 335. In one embodiment, multiple levels can be included in each of members 105 and 106, which each level serving to measure flatness in a different direction. Level 335 can be configured as a bubble level, digital level, or other known leveling device.

Finger fitting cup 340 is also illustrated in FIG. 3. Finger fitting cup 340 is an optional finger cup that can be useful for operators with smaller fingers. The finger fitting cup 340 is formed to fit inside finger cup 110 (or equivalently finger cup 111). An operator may place a finger fitting cup 340 on both an index finger and thumb, if necessary. The finger fitting cup 340 can be worn like a thimble by an operator with smaller fingers. With the finger fitting cup 340 on their fingers, the operator can slip both the finger fitting cup 340 and their finger into finger cup 110 and/or finger cup 111. Finger fitting cup 340 provides the operator a more snug and comfortable fit, allowing the operator to more effectively operate the apparatus 100.

With respect to the system and apparatus shown in FIGS. 1-3, it should be appreciated that the members 105 and 106 can be constructed of any material sufficiently rigid to protect a user's fingers from the downward impact of the driving tool. Thus, the members 105 and 106 can be formed of metal such as tempered aluminum, plastic, rubber, or other polymer. In a preferred embodiment, a combination of these materials can be used. For example, finger cups 110 and 111 can be internally formed of metal and the surround be a rubber or plastic form so that the rubber or plastic form is internally reinforced by the metal. In addition, lanyard 130 can be comprised of a material including, but not limited to, an elastic polymer, leather, and cloth, either alone or in combination.

Figure 4:
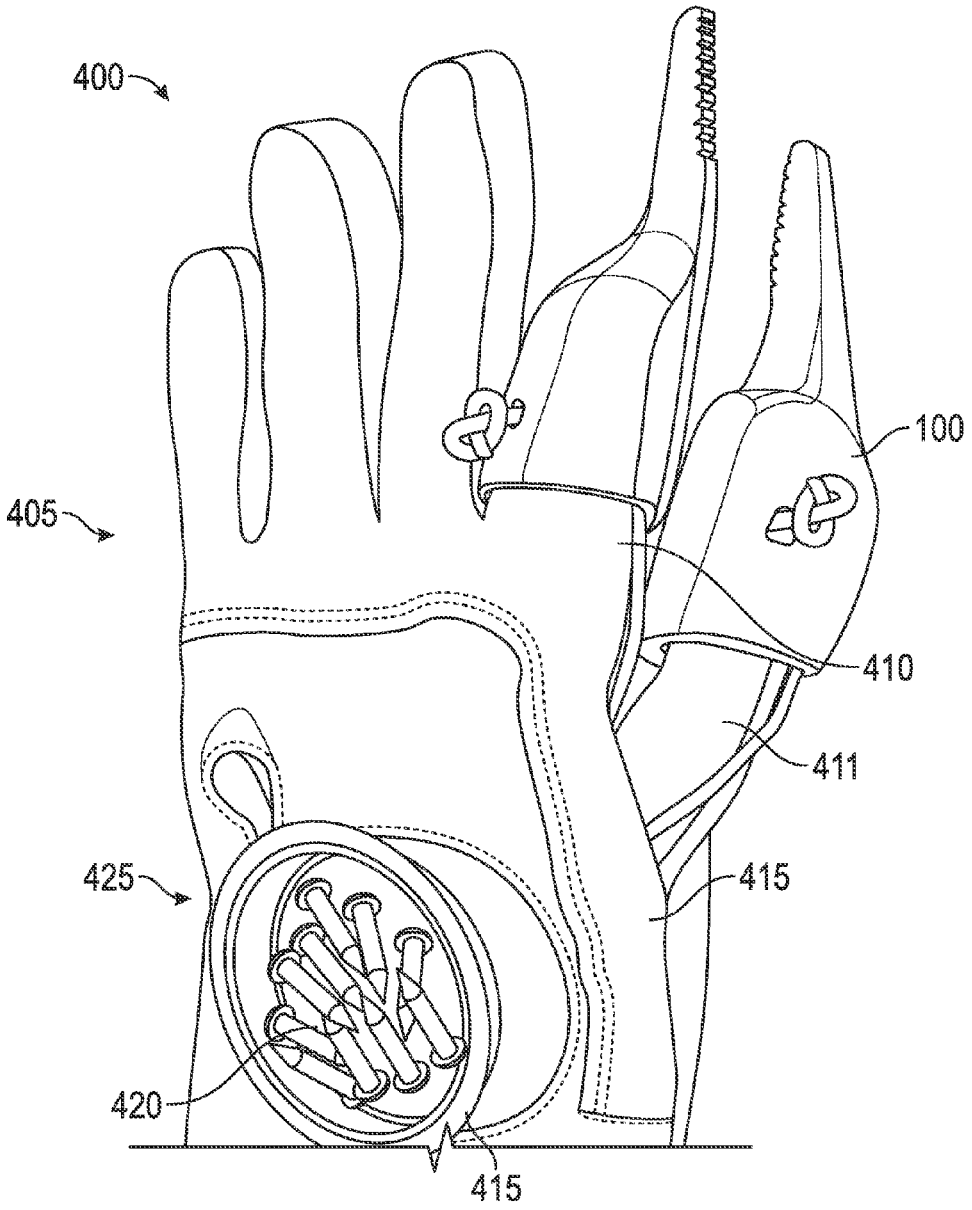
FIG. 4 depicts a top view of a system and apparatus for gripping a nail in accordance with an alternative embodiment.

FIG. 4 illustrates an alternative embodiment 400 of the method and apparatus. Specifically, FIG. 4 illustrates a glove 405. Glove 405 can be configured to include the protective system or apparatus for gripping a nail 100 in the end of the glove's index finger 410 and the glove's thumb 411. In this embodiment, a user can insert their hand into glove 405. The user's index finger and thumb naturally slide into finger cups 110 and 111 as their hand engages the glove 405.

Glove 405 includes a magnetized cup 415. The magnetized cup 415 can preferably be located on the upper palm side 425 or lower palm side of the glove 405. The magnetized cup 415 is configured to hold a plurality of unused nails 420, screws, rivets, tacks, thumbtacks, or the like. The magnetization of magnetized cup 415 ensures these spare nails 420 are not spilled as the user maneuvers their hands to complete a job. In this way the system or apparatus 400 provides a user protection for their fingers as they drive a connecting device into a target as well as the convenience of keeping a supply of connecting devices such as nails 420 readily available to be inserted into the target as needed.

It should be appreciated that FIG. 4 illustrates a left-handed glove 405. Any skilled artisan will appreciate that this design is equally applicable to a right-handed glove according to user preference.

Figure 5:
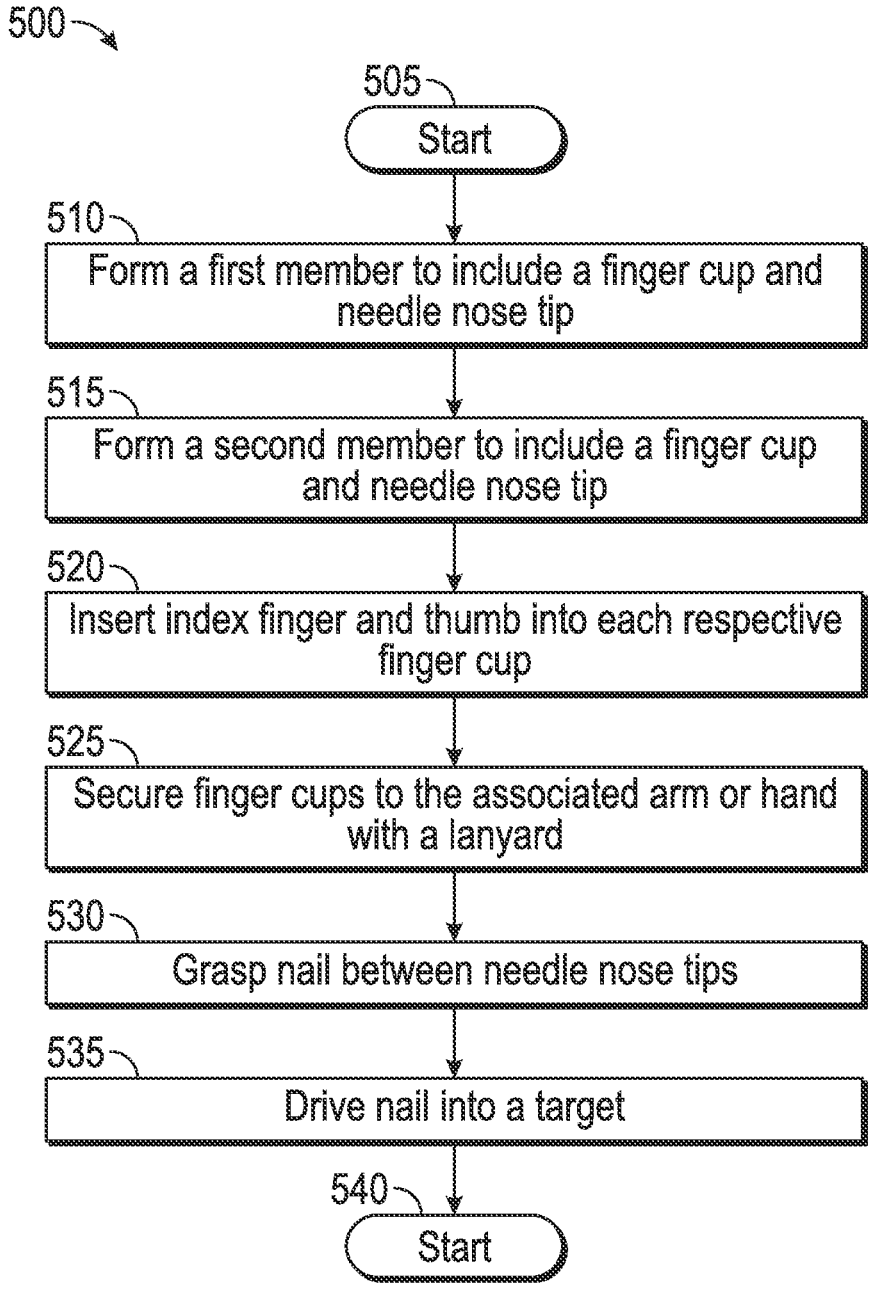
FIG. 5 depicts a high level flow chart illustrating logical operational steps for protecting one's fingers as a nail is driven.

FIG. 5 illustrates a flow chart 500 of logical operational steps for protecting a workman's fingers as a connecting device is being driven into a target in accord with an alternate embodiment of the invention. The method begins at step 505.

The first step is to form a first member 105 to include a finger cup 110 and a needle nose tip 115 as shown at step 510. Next, at step 515, a second member 106 can be formed to include a finger cup 111 and a needle nose tip 116. It should be appreciated that in an alternative embodiment, these steps may include forming a glove, such as glove 405 to include first and second members 105 and 106.

A user can then insert their index finger and thumb into each of finger cups 110 and 111 to engage system 100 as illustrated by step 520. Preferably, the user also secures the finger cups 110 and 111 to the user's arm or hand with lanyard 130 as shown at step 525.

Once the system 100 has been secured to the user's person, a nail 205 can be inserted between needle nose tips 115 and 116. At step 530, the nail 205 is gripped between needle nose tips 110 and 111 by the application of force on member's 105 and 106 by the user's fingers. The teeth 120 and 121 help ensure the nail 205 does not slip from between the needle nose tips 115 and 116.

At this stage, the nail is ready to be driven into the target as illustrated at step 535. The user may operate a driving tool such as a hammer, drill, screwdriver, or the like to drive the nail (or screw) 205 into the target. The user need not worry about the safety of their fingers should the driving device miss the head of the nail 205, as the system 100 is protecting the user's fingers from any accidental impact. The method ends at step 540.

Figure 6:
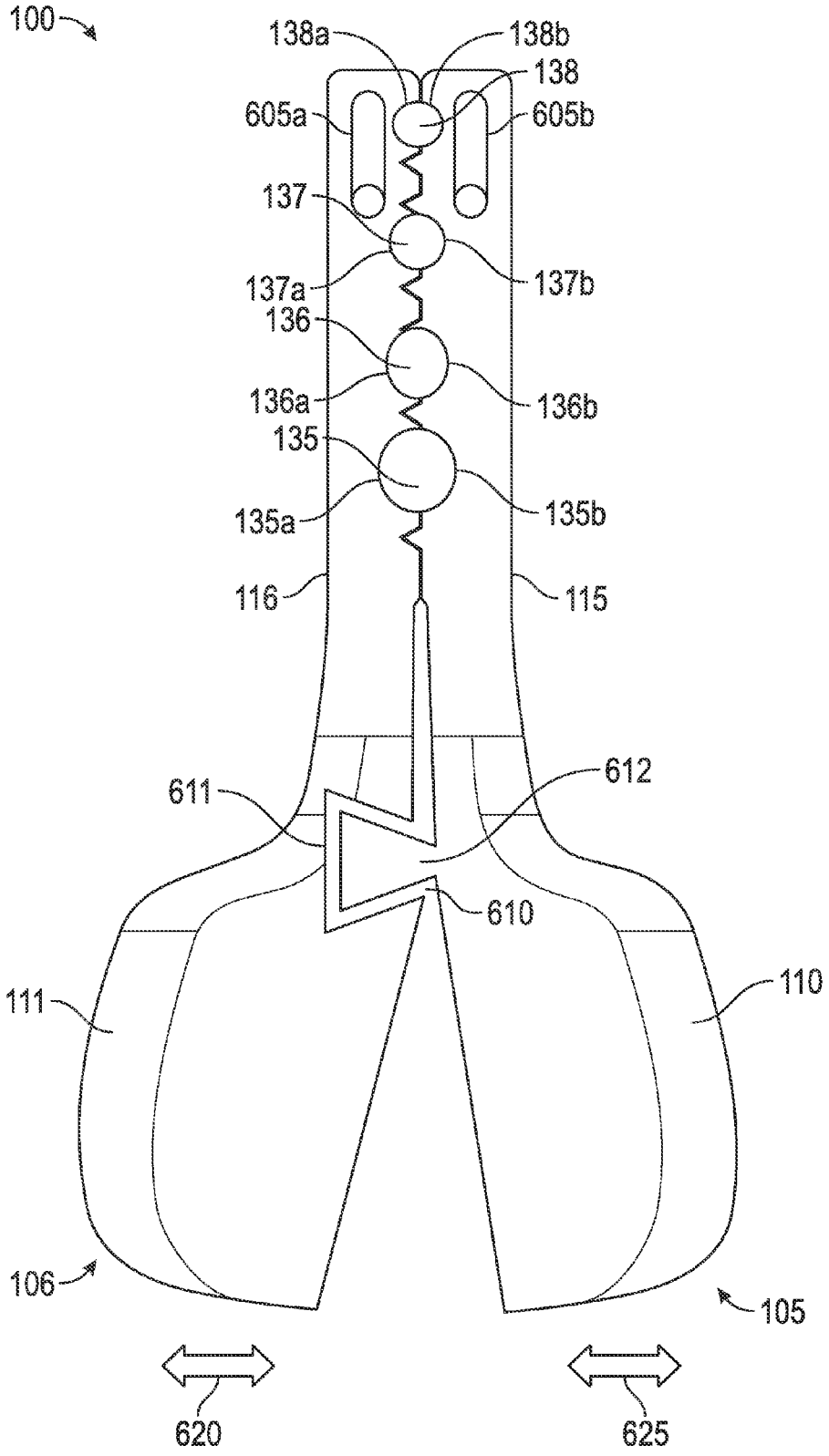
FIG. 6 depicts a bottom view of a system and apparatus for gripping a connecting device in accordance with an alternative embodiment.

FIG. 6 illustrates a bottom view of apparatus 100 in accordance with another embodiment of the invention. In this embodiment, needle nose tips 115 and 116 can include magnets 605*a* and 605*b*, respectively. Magnets 605*a* and 605*b* are preferably integrated into the material forming needle nose tips 115 and 116. In one embodiment, the magnets 605*a* and 605*b* can be located at the tips of needle nose tips 115 and 116. Alternatively, the magnets 605*a* and 605*b* can run the length of needle nose tips 115 and 116. Magnets 605*a* and 605*b* are configured to have a magnetic attraction to connecting members. Thus, when a workman attempts to grip a connecting member, such as a metal nail between needle nose tips 115 and 116, or in recesses 135, 136, or 138, or tubular extension 137, the nail is naturally attracted to its place in the grips.

Magnets 605*a* and 605*b* can further be comprised of a series of smaller magnets and can be included in only one needle nose tip 115 or 116, or alternatively can be formed in both needle nose tips 115 and 116. Magnets 605*a* and 605*b* are preferably formed of permanent or rare earth magnets such as Neodymium Iron Boron, Samarium Cobalt, Alnico, Ceramic, or Ferrite. These choices are preferred because they possess a strong magnetic force and are difficult to demagnetize.

FIG. 6 further illustrates that each of tubular recesses 135, 136, and 138, is formed by two half circle cutouts, one on each of needle nose tip 115 and 116, respectively. Similarly, tubular extension 137 includes two half circle cutouts and two half circle tubular extensions. For example, tubular recesses 135 is formed of a half tubular recess 135*a* on needle nose tip 116 and a half tubular recess 135*b* on needle nose tip 115. It is critical that the half tubular recesses 135*a* and 135*b* are formed on each of the respective needle nose tips 115 and 116 so that when the needle nose tips 115 and 116 are brought together the two halves 135*a* and 135*b* align to form tubular recess 135. This is similarly illustrated for tubular recess 136 which is formed of half tubular recesses 136*a* and 136*b*, tubular extension 137 includes of half tubular recesses which are formed with half tubular extensions 137*a* and 137*b*, and tubular recess 138 which is formed of half tubular recesses 138*a* and 138*b*.

Members 105 and 106 can be joined at joint 610. Joint 610 can be a slot fitted joint comprising a tab fitting 611 formed in finger cup 111 and a joint tab 612 formed in finger cup 110. In one embodiment, joint 610 is formed to allow members 105 and 106 to be fully separated from one another. In that embodiment, joint tab 612 can slide down into tab fitting 611 so that joint 610 is engaged. Joint 610 can be formed of a rubber or other such flexible material so that once joint tab 612 is slid into tab fitting 611, finger cups 110 and 111 can be spread apart or pushed together as indicated by arrows 620 and 625.

It is important to note that this embodiment operates because the material of members 105 and 106, and specifically tab fitting 611 and joint tab 612, is flexible material such as rubber so that movement 620 and 625 is possible. Movements 620 and 625 allow a workman to open and shut needle nose tips 115 and 116 around a connecting device.

In addition, joint tab 612 is formed to be wider on one end and narrower on the other to fit the similar shape of tab fitting 611. This is important because the wider end of joint tab 612 can't be pulled away from, and/or out of, tab fitting 611 when finger cups are operated in directions 620 and 625. However, the shape of joint tab 612 and tab fitting 611 allows members 105 and 106 to be joined by sliding joint tab 612 into joint fitting 611 with a vertical motion so that the two members 105 and 106 can be easily joined or separated. In another embodiment, joint 610 is permanently fitted so that members 105 and 106 are permanently operably connected.

Figure 7A:
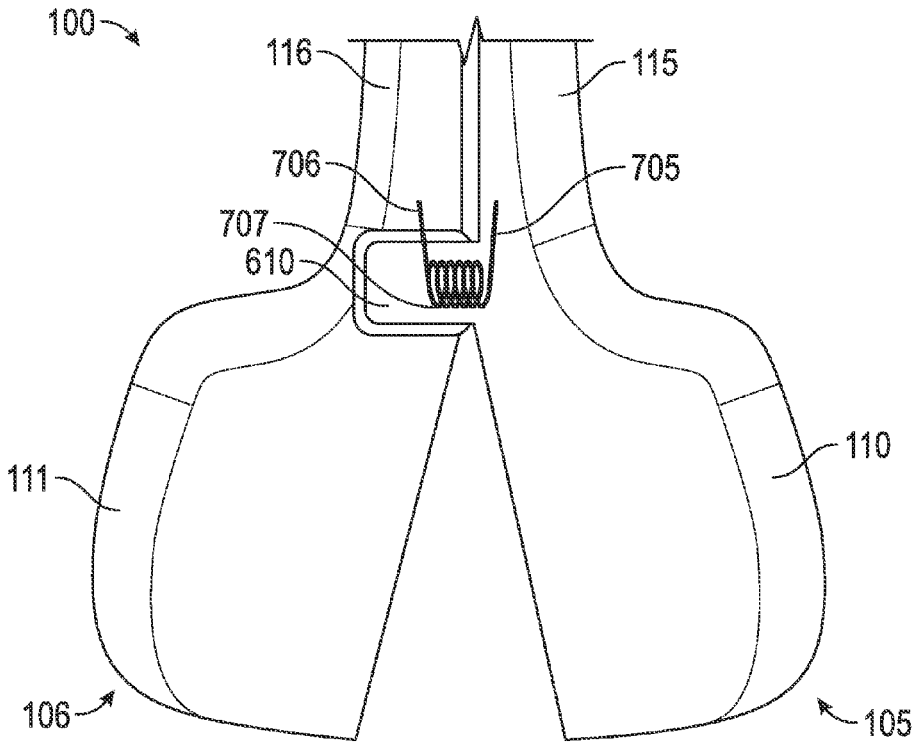
FIG. 7A depicts a bottom view of a system and apparatus for gripping a connecting device in accordance with an alternative embodiment.

FIG. 7A illustrates another embodiment of the invention wherein joint 610 further includes a spring assembly. In this embodiment, the spring assembly includes a spring 707 formed inside joint 610. Each end of spring 707 is connected to a retaining pole. Retaining pole 706 runs through finger cup 111 and into needle nose tip 116. Likewise, retaining pole 705 runs through finger cup 110 and into needle nose tip 115. In this embodiment, the spring causes a force to be applied on retaining poles 706 and 705 that naturally encourages needle nose tips 115 and 116 to move toward each other. Thus, when the apparatus is not in use the needle nose tips 115 and 116 are closed. A workman can apply a force to finger cups 110 and 111 opposing the force of spring 707 to separate needle nose tips 115 and 116. A connecting device can be inserted between the grips while the workman is opposing the force of the spring. When the workman releases, the needle nose tips 115 and 116 will naturally return to the closed position, thereby allowing the workman to hold the connecting device between the needle nose tips 115 and 116 with minimal effort.

Figure 7B:
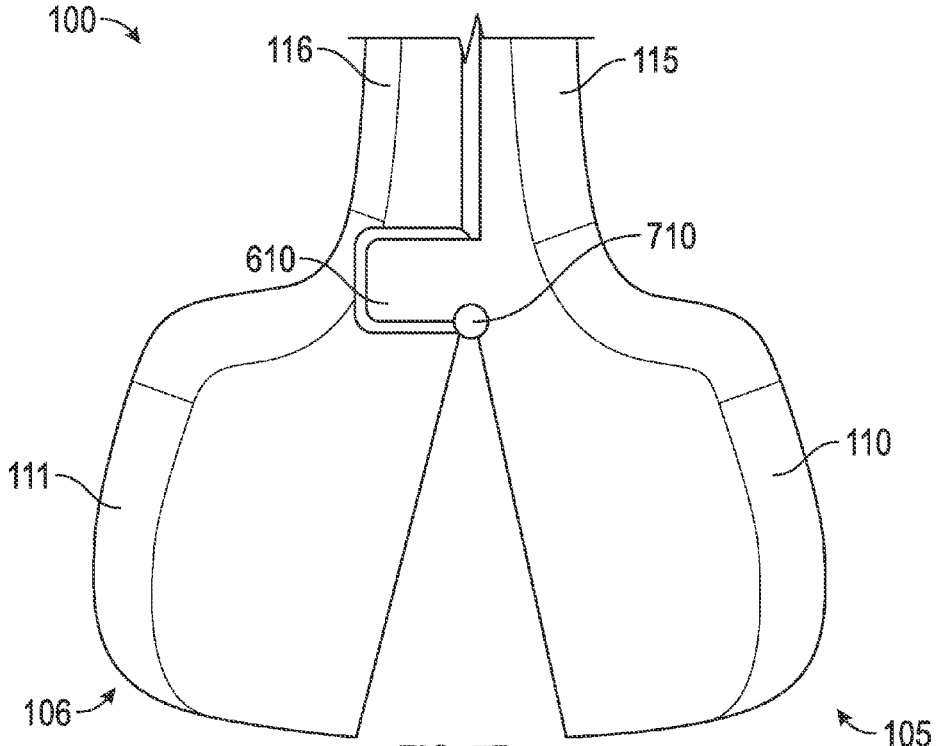
FIG. 7B depicts a bottom view of a system and apparatus for gripping a connecting device in accordance with an alternative embodiment.

FIG. 7B illustrates another alternative embodiment wherein joint 610 is engaged with a hinge 710. In this embodiment, no forces are applied by joint 610 or hinge 710. Hinge 710 can hold joint 610 in place allowing a workman to impart force on needle nose tips 115 and 116 as desired.

Based on the foregoing, it can be appreciated that a number of embodiments, preferred and alternative, are disclosed herein. For example, in one embodiment, an apparatus for holding a connecting instrument comprises a first member comprising a first finger cup and a first needle nose tip formed on a forward end of the first finger cup, a second member comprising a second finger cup and a second needle nose tip formed on a forward end of the second finger cup, and a joint connecting the first member and the second member wherein the first needle nose tip and the second needle nose tip are configured to grip a connecting device. The interior bottom side of the first finger cup and an interior bottom side of the second finger cup are formed with a wedge shape such that an interior forward end of the first finger cup and an interior forward end of the second finger cup are lower than an interior back end of the first finger cup and an interior back end of the second finger cup.

In an alternative embodiment, the exterior bottom side of the first member and the exterior bottom side of the second member are flat. The first finger cup is configured to ergonomically accept a user's index finger and the second finger cup is configured to ergonomically accept a user's thumb.

In yet another embodiment, the apparatus further comprises a first reinforcement formed inside the first finger cup and a second reinforcement formed inside the second finger cup wherein the first reinforcement and the second reinforcement prevent the first finger cup and the second finger cup from deforming when impacted.

In another embodiment, the first needle nose tip and the second needle nose tip further comprise a plurality of teeth for gripping a connecting device.

In another alternative embodiment, the first needle nose tip is formed with a plurality of concave tubular vertical recesses each of the plurality of recesses having a varying diameter and the second needle nose tip is formed with a plurality of matching concave tubular vertical recesses each of the matching plurality of recesses having a varying diameter, wherein when the first needle nose tip is brought in contact with the second needle nose tip the plurality of concave tubular vertical recess and the matching concave tubular vertical recesses align forming a plurality of complete tubular vertical recess formed to accept a connecting device.

In an alternative embodiment, the plurality of concave tubular vertical recesses and the matching concave tubular vertical recess are lined with a layer of at least one of metal, Teflon, nylon, hardened plastic, and rubber. In addition, the plurality of concave tubular vertical recesses and the matching concave tubular vertical recess comprise thread guides to facilitate the movement of a threaded connecting device.

In an alternative embodiment, the apparatus further comprises a first magnet embedded in the first needle nose tip and a second magnet embedded in the second needle nose tip. In one embodiment, the first magnet and the second magnet comprise rare earth magnets.

In another embodiment, the joint comprises a rubber slot fit joint, a hinged joint, and a spring loaded joint.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An apparatus for holding a connecting instrument comprising:

a first member-comprising a first finger cup and a first needle nose tip formed on a forward end of said first finger cup;

a second member comprising a second finger cup and a second needle nose tip formed on a forward end of said second finger cup; and a flexible slot fit joint formed on said forward end of said first finger cup and said forward end of said second finger cup connecting said first member and said second member, the flexible joint comprising a tab fitting formed in the first finger cup and a joint tab formed in the second finger cup so that once the joint tab is slid into the tab fitting, the flexible joint allows the finger cups to be spread apart or pushed together, wherein said first needle nose tip and said second needle nose tip are configured to grip a connecting device.

2. The apparatus of claim 1 wherein an interior bottom side of said first finger cup and an interior bottom side of said second finger cup are formed with a wedge shape such that an interior forward end of said first finger cup and an interior forward end of said second finger cup are lower than an interior back end of said first finger cup and an interior back end of said second finger cup.

3. The apparatus of claim 2 wherein an exterior bottom side of said first member and an exterior bottom side of said second member are flat.

4. The apparatus of claim 3 wherein said first finger cup is configured to ergonomically accept a user's index finger and said second finger cup is configured to ergonomically accept a user's thumb.

5. The apparatus of claim 1 further comprising a first reinforcement formed inside said first finger cup and a second reinforcement formed inside said second finger cup wherein said first reinforcement and said second reinforcement prevent said first finger cup and said second finger cup from deforming when impacted.

6. The apparatus of claim 1 wherein said first needle nose tip and said second needle nose tip further comprise a plurality of teeth for gripping said connecting device.

7. The apparatus of claim 6 wherein said first needle nose tip is formed with a plurality of concave tubular vertical recesses each of said plurality of recesses having a varying diameter; and said second needle nose tip is formed with a plurality of matching concave tubular vertical recesses each of said matching plurality of recesses having a varying diameter, wherein when said first needle nose tip is brought in contact with said second needle nose tip said plurality of concave tubular vertical recesses and said matching concave tubular vertical recesses align forming a plurality of complete tubular vertical recesses formed to accept a connecting device.

8. The apparatus of claim 7 wherein said plurality of concave tubular vertical recesses and said matching concave tubular vertical recesses are lined with a layer of at least one of:

metal;

Teflon;

nylon;

hardened plastic; and rubber.

9. The apparatus of claim 7 wherein said plurality of concave tubular vertical recesses and said matching concave tubular vertical recesses comprise thread guides to facilitate the movement of a threaded connecting device.

10. The apparatus of claim 6 further comprising a first magnet embedded in said first needle nose tip.

11. The apparatus of claim 6 further comprising a second magnet embedded in said second needle nose tip.

12. The apparatus of claim 6 further comprising a first magnet embedded in said first needle nose tip and a second magnet embedded in said second needle nose tip.

13. The apparatus of claim 12 wherein said first magnet and said second magnet comprise rare earth magnets.

14. An apparatus for holding a connecting instrument comprising:

a first member-comprising a first finger cup and a first needle nose tip formed on a forward end of said first finger cup;

a second member comprising a second finger cup and a second needle nose tip formed on a forward end of said second finger cup; and a spring loaded joint formed on said forward end of said first finger cup and said forward end of said second finger cup connecting said first member and said second member, the spring loaded joint comprising a spring with a first end connected to a first retaining pole running through the first finger cup and into the first needle nose tip, and a second end connected to a second retaining pole running through the second finger cup and into the second needle nose tip, so that the spring biases the first needle nose tip and the second needle nose tip to move toward each other, wherein said first needle nose tip and said second needle nose tip are configured to grip a connecting device.

* * * * *

UNITED STATES PATENT AND TRADEMARK OFFICE

CERTIFICATE OF CORRECTION

PATENT NO. : 9,032,844 B2
APPLICATION NO. : 14/173235
DATED : May 19, 2015
INVENTOR(S) : Ivy Bullard It is certified that error appears in the above-identified patent and that said Letters Patent is hereby corrected as shown below:

On the Title Page:
Item (71) Applicant: please delete "Moriarity" and insert therefore -- Moriarty --;

Item (72) Inventor: please delete "Moriarity" and insert therefore -- Moriarty --.

Signed and Sealed this
First Day of December, 2015

Michelle K. Lee

Michelle K. Lee
*Director of the United States Patent and Trademark Office*